US006073562A

United States Patent [19]

Cozine et al.

[11] Patent Number: 6,073,562

[45] **Date of Patent: *Jun. 13, 2000**

[54] RAILWAY CAR OUTLET GATE ASSEMBLY WITH COMPACT INERTIAL LATCH

[76] Inventors: Claud W. Cozine, 610 S. Ash, McPherson, Kans. 67460; Anthony L. Lucas, 1560 28th Rd., Little River, Kans. 67457

[ * ] Notice: This patent is subject to a terminal disclaimer.

[21] Appl. No.: 09/057,920

[22] Filed: Apr. 9, 1998

[51] Int. Cl.[7] ..... B61D 3/00

[52] U.S. Cl. ..... 105/247; 105/305; 105/308.1; 105/286

[58] Field of Search ..... 105/247, 286, 105/305, 308.1

[56] References Cited

U.S. PATENT DOCUMENTS

| | | | |
|---|---|---|---|
| 3,635,170 | 1/1972 | Chierici | 105/282 |
| 3,709,152 | 1/1973 | Gutridge | 105/253 |
| 4,094,254 | 6/1978 | Koranda | 105/282 |
| 4,132,177 | 1/1979 | Funk | 105/310 |
| 4,253,400 | 3/1981 | Fischer et al. | 105/282 |
| 4,256,042 | 3/1981 | Fischer | 105/282 |
| 4,284,011 | 8/1981 | Eagle | 105/310 |
| 4,365,837 | 12/1982 | Mizelle | 297/216 |
| 4,450,773 | 5/1984 | Fritz et al. | 105/282 |
| 4,634,182 | 1/1987 | Tanaka | 297/379 |
| 4,664,442 | 5/1987 | Stolper et al. | 297/216 |
| 5,272,987 | 12/1993 | Lucas | 105/308.1 |
| 5,353,713 | 10/1994 | Dohr et al. | 105/310 |
| 5,448,955 | 9/1995 | Dugge et al. | 105/305 |
| 5,507,235 | 4/1996 | Dugge et al. | 105/282.3 |
| 5,584,251 | 12/1996 | Lucas | 105/305 |

*Primary Examiner*—S. Joseph Morano
*Assistant Examiner*—Robert J. McCarry, Jr.
*Attorney, Agent, or Firm*—Edward J. Brosius; F. S. Gregorczyk; Stephen J. Manich

[57] ABSTRACT

An outlet gate assembly for a hopper type railway car includes a frame adapted to be mounted on an outlet opening in the rail car and a gate in the frame. A conventional rack and pinion opening and closing drive moves the gate between open and closed positions on the frame. An inertial latch mechanism latches the gate in the fully closed position. Actuation of the opening and closing drive displaces the latch to automatically unlatch the gate. Upon impact, an inertial mass bears directly against the latch and transmits a latching force holding the latch closed and preventing opening of the gate.

34 Claims, 6 Drawing Sheets

RAILWAY CAR OUTLET GATE ASSEMBLY WITH COMPACT INERTIAL LATCH

FIELD OF THE INVENTION

The invention relates generally to outlet gate assemblies for railway hopper cars of the type having a latch mechanism which holds the gate closed and unlatches and relatches the gate when the gate is driven between closed and open positions.

BACKGROUND OF THE INVENTION

Hopper-type railroad cars are used to transport lading which is discharged through outlet gate assemblies mounted on discharge openings at the bottoms of the cars. Each outlet gate assembly includes a flat door or gate and a drive for moving the gate between open and closed positions. When closed, the gate prevents discharge of lading. When the gate is opened, the lading is free to discharge through the assembly. Latches are used to prevent opening of the gates by high energy impacts between rail cars.

Many conventional gate assemblies use rack and pinion opening and closing drives to shift the gate between open and closed positions. Racks are mounted on the gate. A capstan on one end of an operating shaft is rotated in an appropriate direction to rotate pinion gears on the shaft, shift the racks and move the gate in a desired direction. The rack and pinion drives are mechanically connected to a movable latch by a lost motion latch drive. The latch is positively retracted during initial rotation of a capstan, prior to initial movement of the closed gate in the opening direction. The latch is withdrawn before the gate moves. During impact the latch can become wedged or hooked in place while holding the gate closed.

Another conventional gate assembly uses a rack and pinion drive including a resilient member positioned between adjacent teeth on a rack. The resilient member engages a tooth of a pinion gear to prevent accidental opening. Rotation of the pinion gear deforms the resilient member to allow the gate to be moved from the closed locked position to the open, unlocked position.

Each of the above conventional gate assemblies is latched by a mechanism forming part of the gate opening and closing drive. These latch mechanisms cannot be used with other types of gate opening and closing drives because the latching mechanism is an integral part of the particular drive. Many of the gate assemblies require a lost motion latch drive to open the latch prior to moving the gate in the opening direction. Such latch drives are difficult and costly to manufacture and install.

Further, wedge-type latches can become jammed against the gate by impact, making unlatching and opening of the gate difficult.

To address the shortcomings of conventional gate assemblies, an outlet gate assembly having an inertial latch mechanism has been developed. The inertial latch mechanism automatically latches and unlatches independently of the gate opening and closing drive. The inertial latch mechanism includes a latch connected to an inertial mass by a two-bar linkage. The inertial mass generates a latching force upon impact. During impact, an inertial force generated by the mass is applied to the latch through the two bar linkage.

The inertial latch mechanism has substantial advantages over conventional outlet gate assemblies. However, the two-bar linkage is complicated and bulky and is expensive to manufacture. A simpler, more compact and less expensive inertial latch mechanism with improved reliability is desirable.

SUMMARY OF THE INVENTION

The present invention is an outlet gate assembly with a direct-acting inertial latch mechanism for holding the gate closed against impacts. A latch is located in the path of movement of the inertial mass. During impact, the inertial mass bears directly against the latch. The direct-acting inertial mass generates an inertial force sufficient to hold the latch closed without force multiplication linkage. Elimination of the force multiplying two-bar linkage eliminates parts and simplifies construction. The cost of the inertial latch mechanism is reduced and a more compact assembly obtained. Friction inherent in the two-bar linkage is eliminated. The direct acting inertial latch is more easily unlatched than the prior inertial latch using a two-bar linkage.

Easy opening reduces the torque required to open a gate using the direct-acting latch.

An outlet gate assembly includes a conventional rectangular frame, a conventional gate and a conventional rack and pinion-type opening and closing drive. A direct-acting inertial latch mechanism holds the gate closed against impacts and is opened by physical contact by the gate as the gate is moved open by the drive. The gate drive includes an operating shaft which is rotated to move the gate in an opening direction. This opening movement brings the gate against the latch and pushes the latch out of the path of the gate. The direct-acting inertial latch is opened by the gate, and operates independently of the conventional opening and closing drive.

The inertial latch mechanism includes a latch movable into and out of the path of opening movement of the gate, an inertial mass movably mounted on the frame, and a support shaft journaled to the frame. The latch is mounted on the support shaft for opening and closing the gate. Rotation of the support shaft rotates the latch in opening and closing directions. The latch is located adjacent to and in the path of impact travel of the inertial mass. On impact, the inertial mass bears directly against the latch. The inertial force generated by the inertial mass is directly applied to the latch in a direction to resist opening of the latch by the gate. When the gate is closed the inertial latch mechanism holds the latch in the closed position to prevent opening of the gate by vibration, train action and other low energy loadings.

The opening and closing drive is used to open and close the gate. Actuation of the drive to open the gate pushes the gate against the latch. The gate applies an opening force against the latch. This opening force rotates the latch in the opening direction out of the opening path of the gate. Once the gate closes and clears the latch, the latch returns to the closed position.

The inertial latch mechanism is completely independent of the opening and closing drive, operates during impacts to prevent opening of the gate and permits ready opening of the gate by the opening and closing drive. Opening and closing drives other than rack and pinion drives may be used if desired.

During impacts moving the gate toward the closed position a one-way connection between the inertial mass and the latch permits free inertial movement of the inertial mass without displacement of the latch.

Other objects and features of the invention will become apparent as the description proceeds, especially when taken in conjunction with the accompanying drawings illustrating the invention, of which there are ten sheets.

DESCRIPTION OF THE PREFERRED EMBODIMENT

Figure 1:
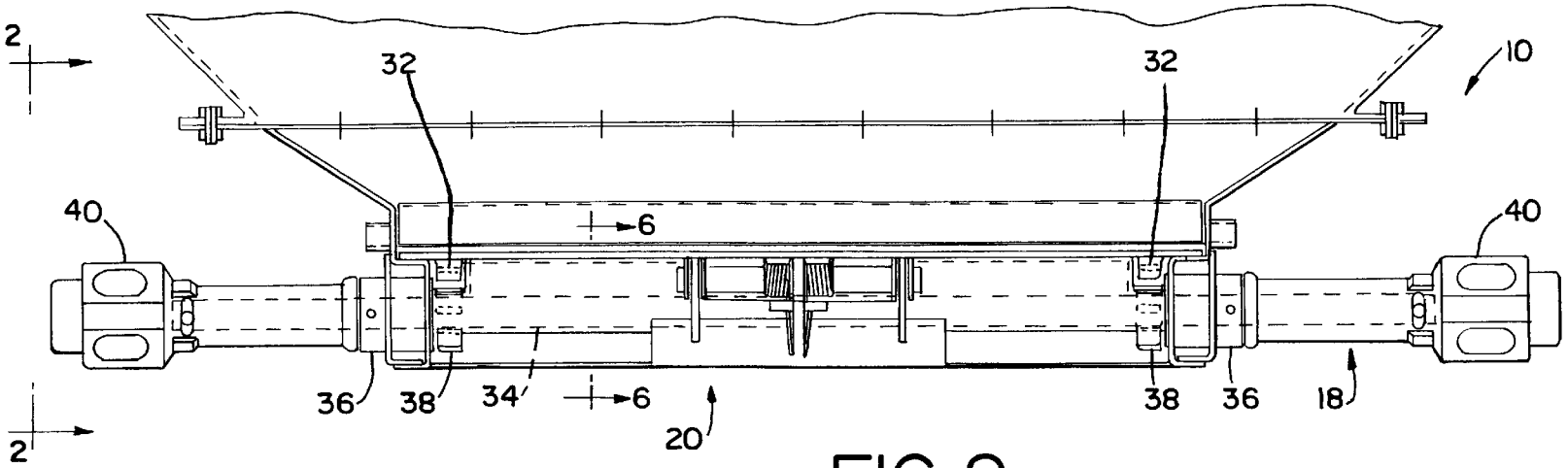
FIG. 1 is a front view of an outlet gate assembly with an inertial latch mechanism in accordance with the invention.

Outlet gate assembly 10 includes a rectangular frame 12 defining a discharge opening 14. A rectangular door or gate 16 is mounted in frame 12 and is movable between a closed position in which the gate 16 completely closes opening 14 and an open position in which the gate 16 is to one side of opening 14. The gate 16 is moved between the open and closed positions by a gate opening and closing drive 18. A direct-acting inertial latch mechanism 20 latches the gate 16 in the closed position.

The frame 12 of the outlet gate assembly 10 is bolted to a discharge opening in the bottom of a hopper-type railway car (not shown) to control the discharge of lading from the car. The outlet gate assembly may also be bolted to a transportable hopper, for example, an over-the-road hopper-type trailer pulled by a tractor truck.

Figure 2:
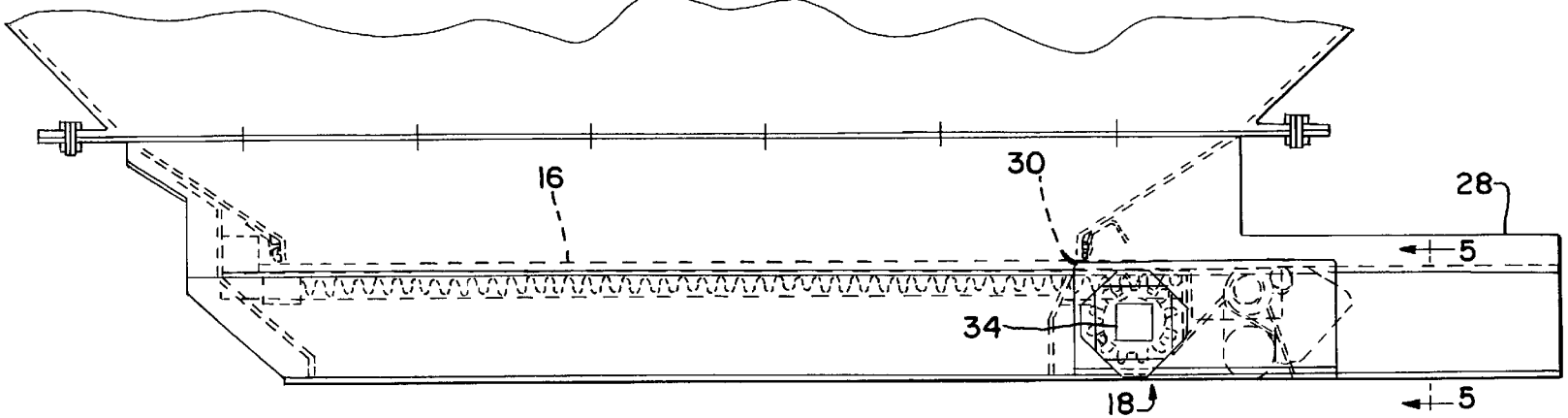
FIG. 2 is a side view of the assembly of FIG. 1 taken along line 2—2 of FIG. 1.
Figure 3:
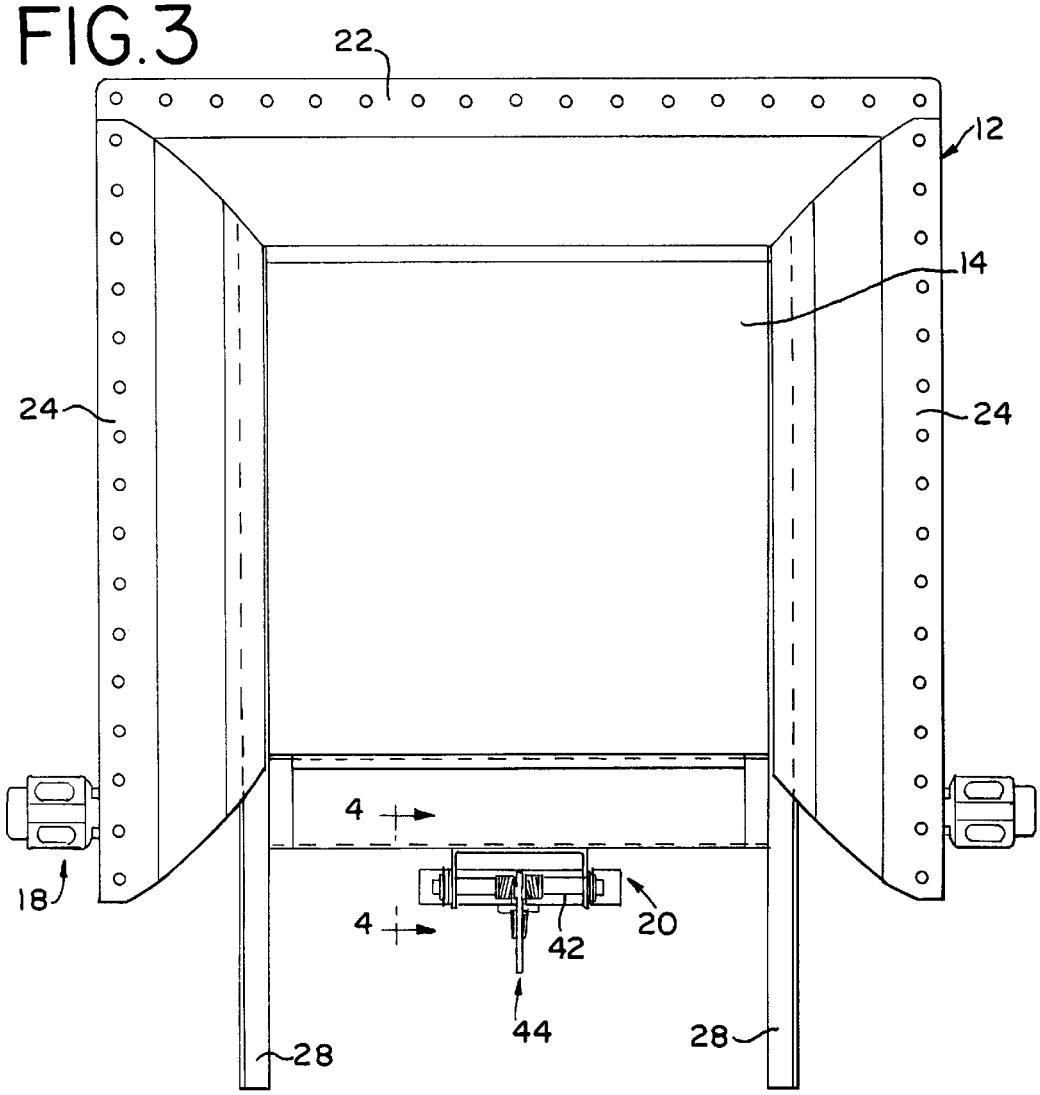
FIG. 3 is a top view of the assembly of FIG. 1.

The frame 12 includes a rear frame member 22, a pair of side frame members 24, and a front frame member 26 to define the discharge opening 14. Extensions 28 of side frame members 24 project beyond the front frame member 26. The gate 16 extends through a slot 30 formed in the front frame member 26 as shown in FIG. 2.

The gate 16 is moved from the closed position out through slot 30 to the open position by gate opening and closing drive 18 mounted on side frame member extensions 28. The drive 18 is conventional and includes a pair of spaced apart parallel racks 32 mounted on the lower surface of gate 16, a square operating shaft 34 extending between and through side frame extensions 28 and journalled in bearings 36 mounted on the extensions 28 and a pair of pinion gears 38 meshed with the teeth of racks 32. The pinion gears 38 are fixedly mounted on the operating shaft 34 and rotate with the operating shaft 34. The ends of the operating shaft 34 extend outwardly or outboard of the frame side extensions 28. A pair of capstans 40 are fixedly mounted on the ends of the operating shaft 34 and rotate with the operating shaft 34. The capstans are directly coupled to the gate so that rotation of a capstan moves the gate open and closed without lost motions.

Inertial latch mechanism 20 includes a support shaft 42, an inertial latch assembly 44 mounted on the support shaft, and springs 46 wound around support shaft 42. Support shaft 42 extends partway across the width of frame 12 below the opening and closing path of gate 16 and is journaled in arms of a U-shaped bracket 48 attached to front frame member 26.

Figure 4:
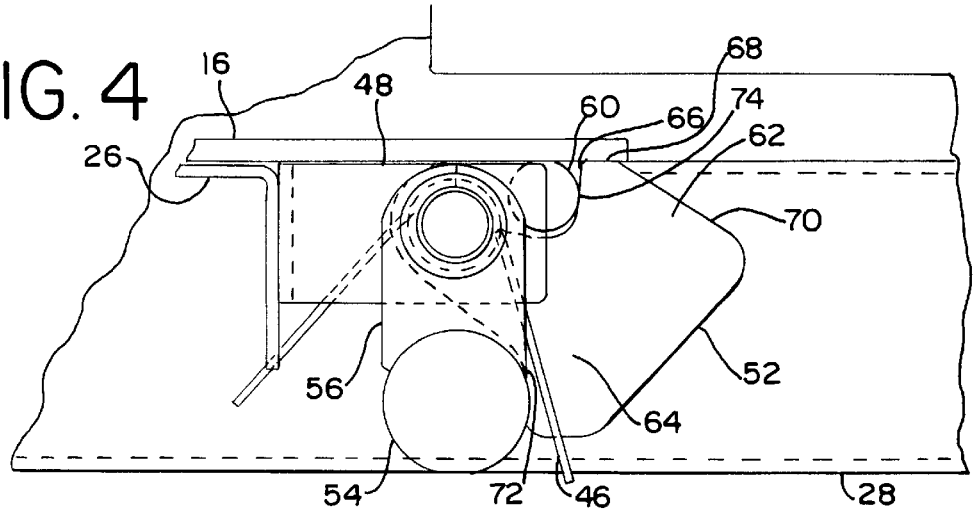
FIG. 4 is a partial side view of the assembly of FIG. 3 taken along line 4—4 of FIG. 3.
Figure 5:
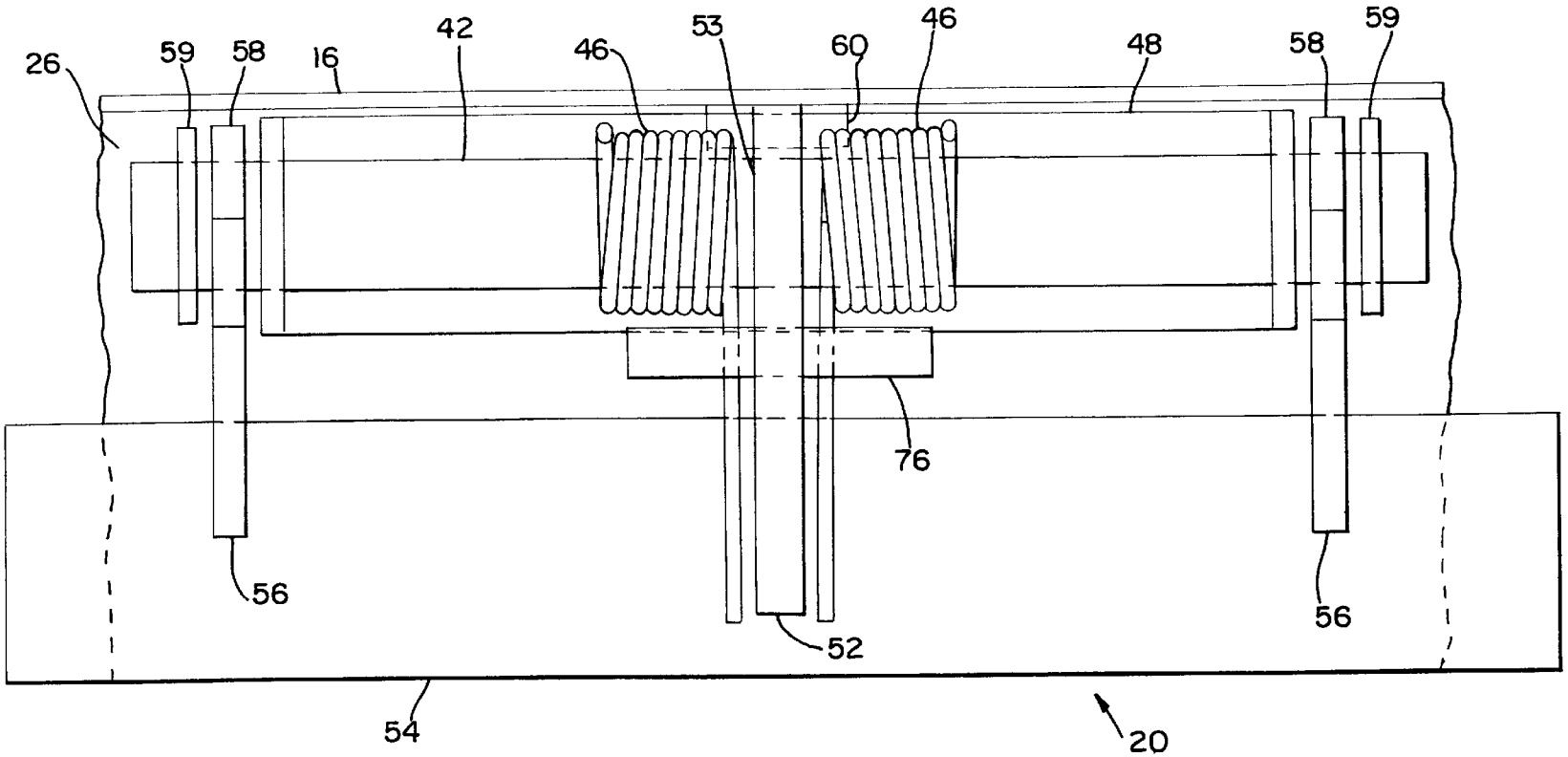
FIG. 5 is a partial end view of the assembly of FIG. 2 taken along line 5—5 of FIG. 2.

Inertial latch assembly 44 includes a latch 52 and a cylindrical, rod shaped inertial mass 54 supported on a pair of like arms 56. The upper ends of arms 56 surround and rotate on shaft 42. Latch 52 is nonrotatably secured to support shaft 42, preferably by weldments 53. Latch 52 is located between the arms of the U-shaped bracket. The upper ends 58 of arms 56 are mounted on and rotatably surround support shaft 42 outboard of the bracket arms. Mass 54 is mounted on lower ends of arms 56 and is free to swing on shaft 42. The mass 54 extends between the arms 56 and is located support shaft 42, closely adjacent to latch 52 as shown in FIGS. 4 and 5. Like retention rings 59 are mounted to the ends of shaft 42. To form a compact assembly, inertial mass 54 preferably does not extend below the bottom of side frame extensions 28.

Gate 16 includes a gate catch 60 attached to the bottom of the gate adjacent the forward edge of the gate. Catch 60 and latch 52 engage one another to hold gate 16 in the closed position. Latch 52 includes an upper nose 62 and a lower extension 64. Upper nose 62 includes latch surfaces 66 and cam surfaces 68 and 70. Cam surface 66 is preferably offset from the vertical by about 3 degrees clockwise as shown in FIG. 4 when the latch is in the latched position. Lower extension 64 extends downwards alongside adjacent inertial mass 54 and defines a lower surface force receiving 72 immediately adjacent inertial mass 54.

Latch surface 66 engages catch 60 at a latch contact point 74 to prevent opening of the gate 16 and to permit positive displacement of latch 52 by the gate when the gate 16 is moved from the closed position towards the open position by drive 18, as will be described in greater detail below.

Two coil springs 46 are fitted on shaft 42 to either side of the latch. One end of each spring engages pin 76 on the latch. The other end of each spring engages front frame member 26. The springs bias latch 52 in a counterclockwise direction as shown in FIG. 4. Inertial mass 54 preferably hangs vertically below the support shaft and does not rotationally bias the shaft 42. However, in other embodiments inertial mass 54 may be vertically offset with respect to support shaft 42 so that the weight of inertial mass 54 biases the support shaft in a counterclockwise direction as shown in FIG. 4, to help hold the latch closed.

The operation of the outlet gate assembly 10 in opening and closing the outlet gate assembly 10 will now be described.

Figure 6:
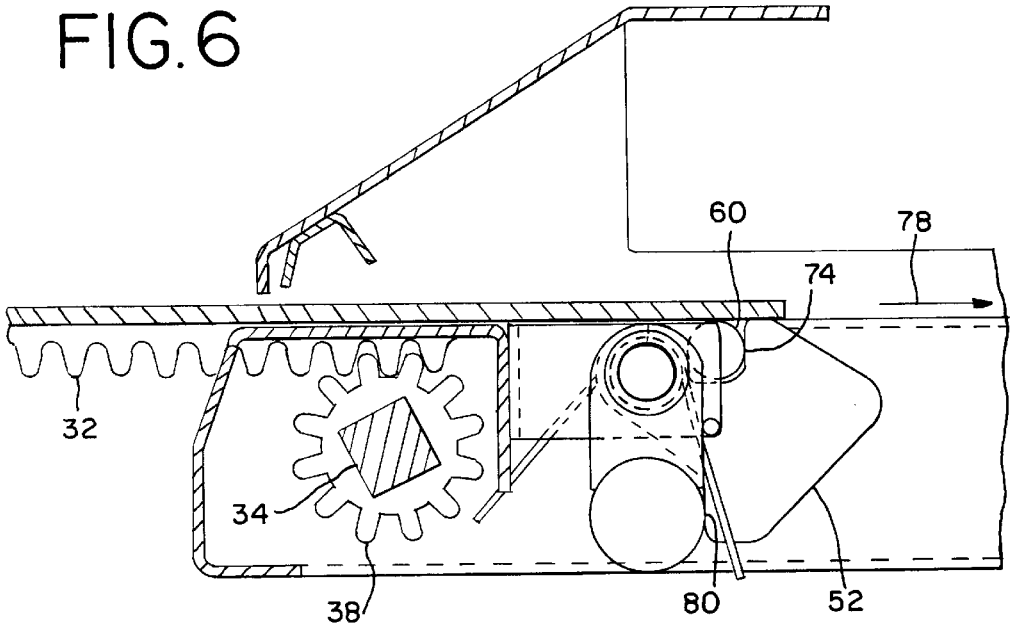
FIG. 6 is a sectional view taken along line 6—6 of FIG. 1 illustrating the outlet gate assembly in the closed position.
Figure 7:
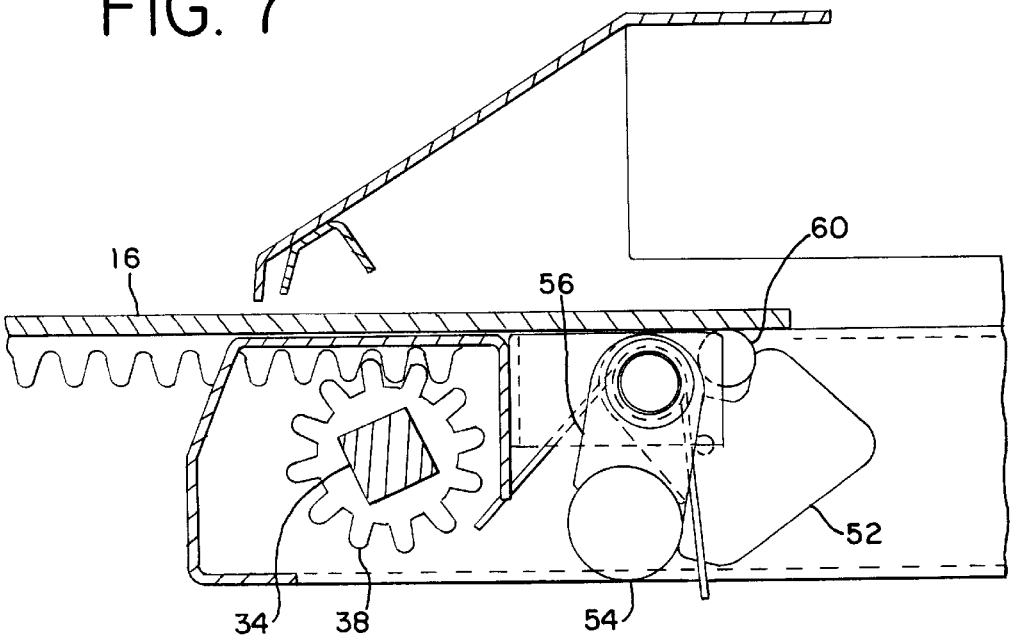
FIG. 7 is a sectional view taken generally along line 5—5 of FIG. 1 illustrating initial opening of the outlet gate assembly.
Figure 8:
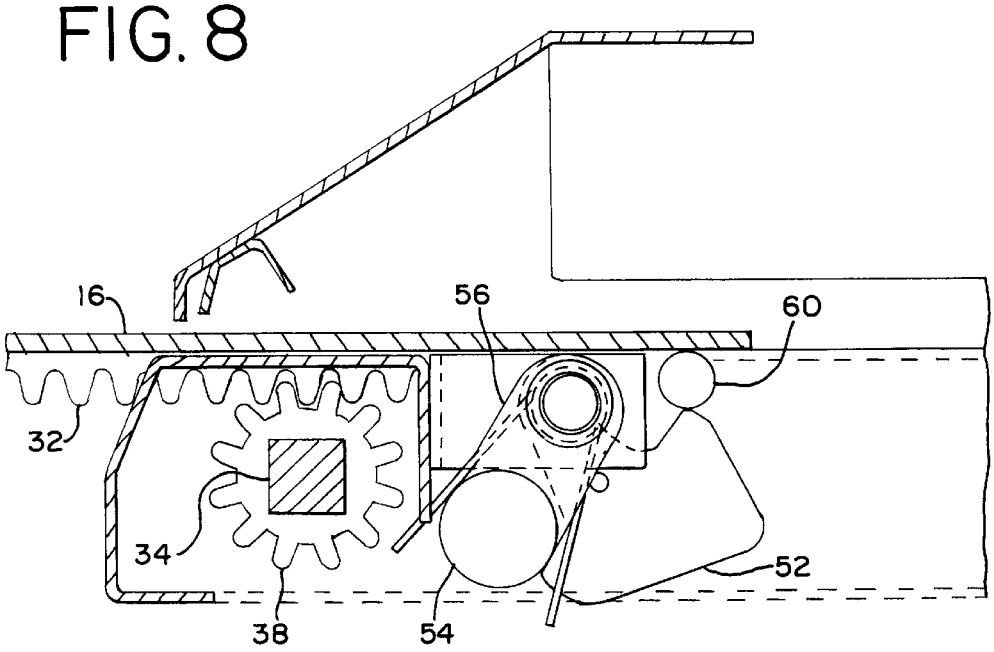
FIGS. 8–10 are sectional views similar to FIG. 7, but illustrating further openings of the outlet gate assembly.
Figure 9:
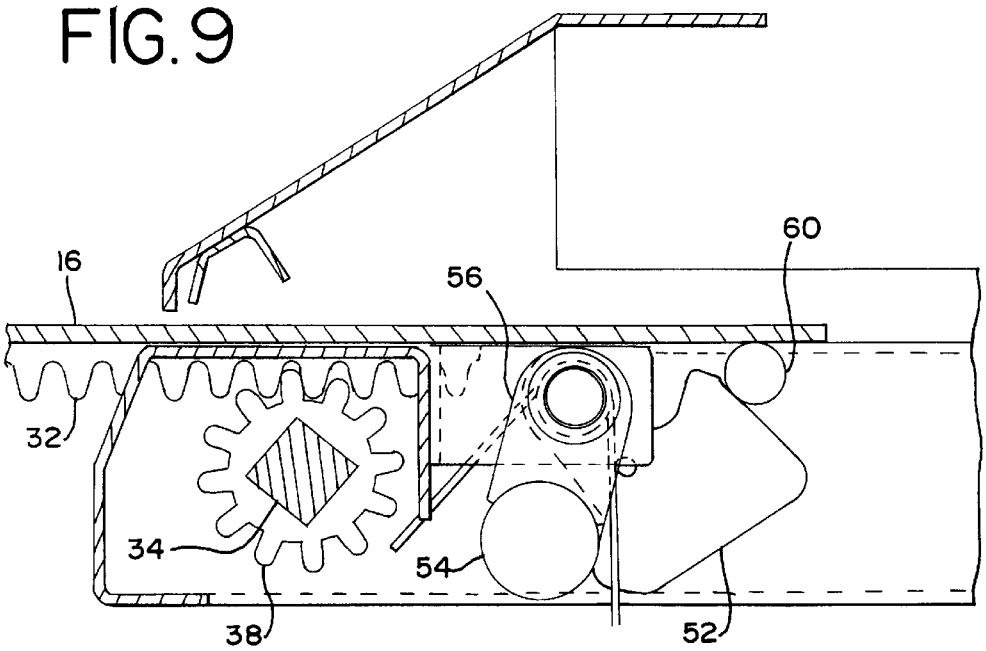

When gate 16 is fully closed as in FIGS. 5 and 6, springs 46 hold latch nose 62 against the bottom surface of the gate. In this position, latch 52 in the opening path of catch 60 and latch surface 66 obstructs catch 60 to hold the gate 16 closed. The torque applied by the springs 46 is sufficient to maintain the latch in the position shown in FIG. 6 to prevent opening of gate 16 due to vibration of the railcar during transit, train action loadings and other low energy loadings experienced by the railcar.

The outlet gate assembly 10 may be opened from either side of the rail car by a worker rotating one of the capstans 40 in an opening direction. The worker may rotate the capstan by using a power drive or a pry bar.

Opening rotation of a capstan 40 rotates the operating shaft 34 and the pinion gears 38 meshed with racks 32 to move the gate 16 in the opening direction of arrow 78 shown in FIG. 6. Catch 60 carried by gate 16 pushes on the latch at the latch contact point 74 of surface 66 and applies an opening force against surface 66. The opening force generates a torque or moment rotating the latch in a clockwise direction as shown in FIG. 6. As gate 16 moves from the closed position towards the open position, catch 60 slides along surface 66, rotating the latch in an opening clockwise direction. Latch lower surface 72 engages inertial mass 54, rotating the inertial mass up about the support shaft. The latch is rotated out of the opening path of the catch, thereby automatically unlatching the outlet gate assembly 10 in response to opening of the gate by drive 18.

Figure 10:
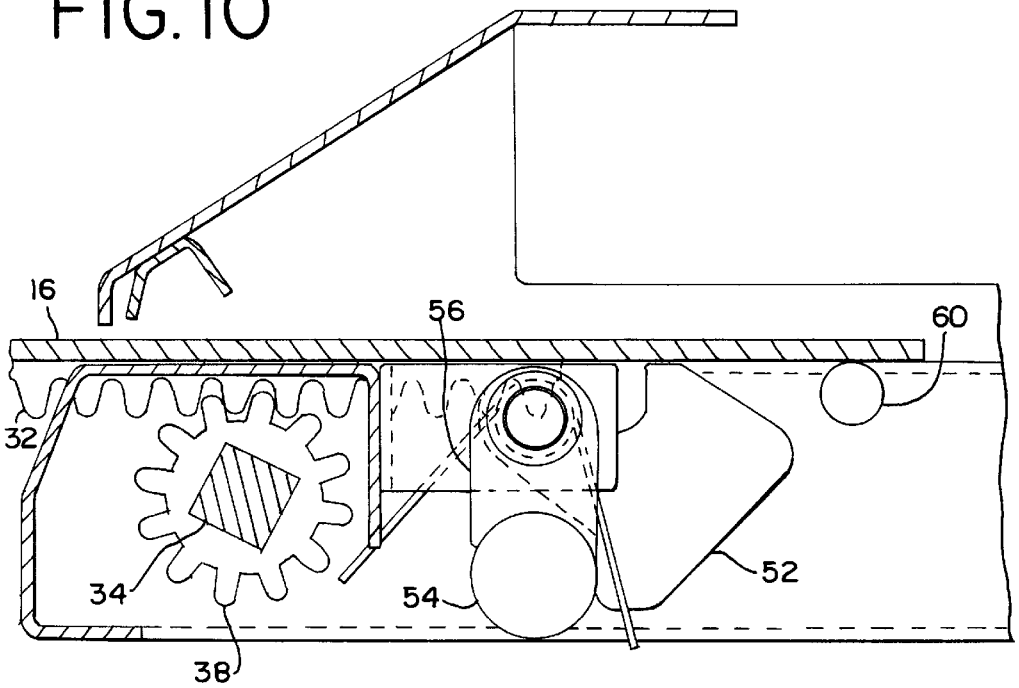

The gate opening and closing drive 18 generates sufficient opening force to overcome the torque of springs 46 and rotate inertial mass 54 to a raised offset position. Once the catch is free of the latch, spring 46 and the offset inertial mass 54 rotate 10 the latch back toward the closing direction. Surfaces 66 and 68 engage the catch to control the closing rotation of the latch as the catch moves away from the latch. The latch returns into the closing path of the catch, with surface 68 engaging the bottom of the gate as shown in FIG. 10. The inertial latch mechanism 20 remains in the position shown in FIG. 10 as the gate 16 is moved to the fully open position.

The fully open outlet gate assembly 10 is moved to the fully closed and latched position by rotating either of the capstans 40 in a closing direction. Closing rotation of the capstans 40 will rotate the operating shaft 34 and the pinions gears 38 to move gate 16 inwardly. As the gate 16 is moved to the fully closed position, catch 60 engages latch cam surface 70. Catch 60 carried by gate 16 pushes on cam surface 70 and rotates the latch in a clockwise direction as shown in FIG. 10. Rotation of the latch rotates the inertial mass up about the support shaft. With continued rotation the latch is moved out of the closing path of the catch. Further closing movement of the gate moves catch 60 past the latch and the springs 46 and mass 54 returns the latch to the latched position of FIG. 4 thereby automatically relatching the outlet gate assembly 10 in response to closing of the gate by drive 18. During closing of the gate, surfaces 68 and 66 engage the catch to control the closing rotation of the latch as the catch moves away from the latch. The latch returns to its latched position pressing against the bottom of the gate to latch gate 16 closed.

High energy impacts which sharply move the railcar in a direction opposite to the opening direction of gate 16 expose the outlet gate assembly 10 to inertial accelerations tending to move the closed gate 16 in the opening direction. An example of such an impact is the impact of the railway car with a stationary line of railway cars during coupling. If the railway car with the outlet gate assembly 10 shown in FIG. 2 is impacted or accelerated to the left, an inertial force would be exerted on gate 16 in the opening direction and, absent the inertial latch mechanism 20, gate 16 could undesirably open.

The operation of the outlet gate assembly 10 to hold the gate closed during an impact will now be described.

The outlet gate assembly 10 is in its closed position as shown in FIG. 6 when an impact occurs tending to move the gate 16 in the opening direction. The impact acceleration causes the gate through catch 60 to apply an opening force to latch 52 tending to rotate the latch from the latched position to the unlatched position.

Inertial mass 54 senses the impact acting on the railway car. The impact moves the frame in the closing direction. The inertial mass 54 is accelerated in the opening direction relative to the frame, that is, to the right as shown in FIG. 2. This acceleration of mass 54 generates an inertial force that biases mass 54 and arms 52 in a counterclockwise direction about support shaft 42 and against point of contact 80 of force receiving surface 72. The inertial force acting against latch contact point 78 generates a torque or moment attempting to rotate the latch in a counterclockwise direction which holds latch 52 against the bottom surface of gate 16. Simultaneously, the impact acceleration of gate 16 causes catch 60 to push against latch 52 at latch contact point 74 with an opening force. In the absence of the inertial force, the opening force pushing against latch 52 would rotate the latch in the opening or clockwise direction and rotate the latch out of the opening path of the catch, freeing the gate to move open. The inertial force holds the latch against the bottom of the gate during impact and prevents the opening force applied by catch 60 from opening the latch. The gate is held closed during impact.

Once the impact dissipates latch 52 is held in the closed position against the gate by the biasing force generated by springs 46, as described above.

Gate 16 is relatively massive. Multi G impacts subject the inertial latch mechanism to high opening forces tending to rotate the latch open, as previously described, because the line of action of the opening force is offset from the axis of rotation of the support shaft. For each impact, the opening force tending to rotate the latch open is resisted by the inertial force generated by mass 54. The geometry of latch 52 assures that the counterclockwise moment exerted on latch 52 by the inertial force holds the latch in place despite the high opening force exerted on the latch by the relatively heavy plate. Preferably the distance between the axis of rotation and contact point 80 is greater than the distance between the axis of rotation and contact point 74. The latch mechanism is held closed so that the impact does not open the gate.

The opening torque applied to latch 52 by gate 16 is proportional to the mass of gate 16 multiplied by a first lever arm (the distance between the shaft axis and contact point 72). The resisting torque applied to latch 52 by inertial mass 54 in opposition to the opening torque is proportional to the mass of inertial mass 54 multiplied by a second lever arm (the distance between the shaft axis and contact point 80). The length of the second lever arm is preferably greater than the length of the first lever arm so that the mass of the inertial mass may be reduced. Preferably the ratio of the length of the second lever arm in relation to the length of the first lever arm is about or greater than 4:1.

To maintain a compact assembly, it is preferable that inertial mass 54 not extend below side frame members 28. This may limit the maximum length of the second lever arm. However, different embodiments of the outlet gate assembly may have gates of different size. The resisting torque may be increased by lengthening the inertial mass across the frame.

Figure 11:
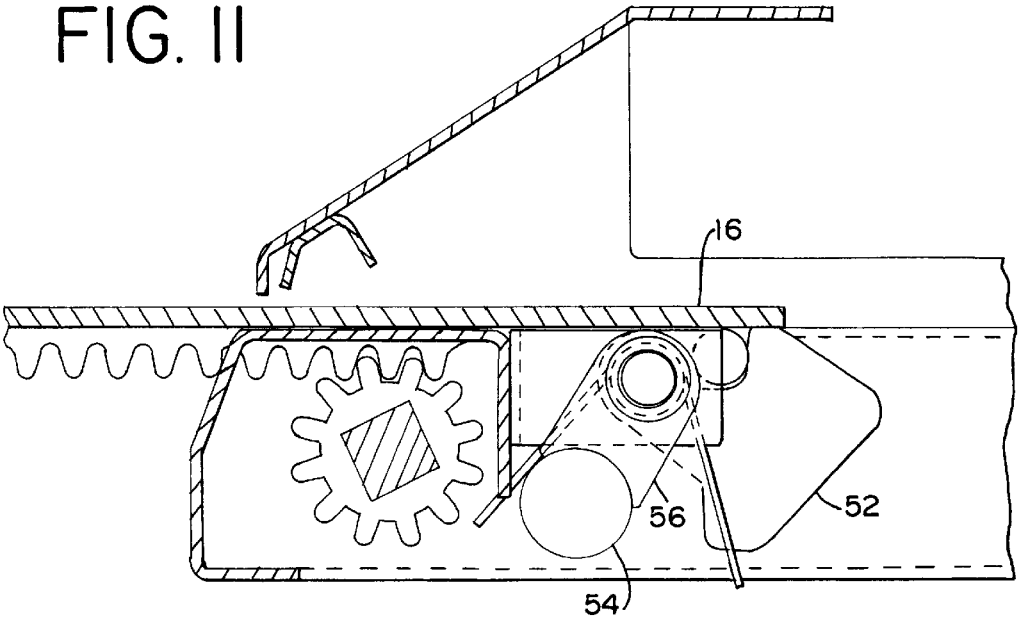
FIG. 11 is a sectional view similar to FIG. 6, but illustrating an impact tending to maintain the outlet gate assembly closed.

If the outlet gate assembly 10 is subjected to an impact tending to move the gate 16 in the closing direction (to the left as shown in FIG. 6) when the gate 16 is in the closed position, the rear frame member 22 will prevent movement of the gate 16, The impact will accelerate inertial mass 54 to the left with respect to the frame 12 and will cause inertial mass 54 to rotate in a clockwise direction about the support shaft 42 free of the latch without transmitting torque to the support shaft 42 (see FIG. 11). Since relative motion is possible between the latch and the inertial mass, the direct-acting inertial latch mechanism 20 is not opened by the impact. The inertial mass 54 and force receiving surface 72 of the latch 52 may separate from each other when the outlet gate assembly is impacted in a direction tending to move tire gate in a closing direction. Clockwise rotation of inertial mass 54 about the support shaft 42 is limited by frame 12, although a limit member rigidly attached to frame 12 can alternatively be provided. Springs 46 hold the latch closed.

Although the embodiment of the invention included a rack and pinion gate opening and closing drive 18, it should be understood that alternative gate opening and closing drives can be provided, as required. The inertial latch mechanism operates independently of the gate opening and closing drive.

While we have illustrated and described a preferred embodiment of the invention, it is understood that these embodiments are capable of modification, and we therefore do not wish to be limited to the precise details set forth, but desire to avail ourselves of such changes and alterations as fall within the purview of the following claims.

What is claimed is:

1. An outlet gate assembly for a hopper-type railway car, said assembly comprising:

a frame defining a generally rectangular discharge opening;

a generally rectangular discharge gate mounted on said frame for opening and closing the discharge opening said gate being movable between opened and closed positions along a predetermined path of travel;

a drive shaft mounted on said frame;

a rack on said gate;

a pinion gear mounted on said drive shaft, said pinion gear engaging said rack so that rotation of the drive shaft moves said gate between opened and closed positions; and an inertial latch mechanism including a latch, a latch rotary connection mounting the latch to said frame for rotation about an axis, said latch rotary connection permitting rotation of the latch between a latched position holding said gate closed and an unlatched position permitting opening of the gate, an inertial mass, a mass rotary connection mounting the inertial mass to said frame for rotation about said axis, said mass rotary connection permitting movement of the inertial mass relative to the frame, said latch including a latch surface located to receive an impact force from the gate acting to rotate said latch about said axis toward the unlatched position and a force receiving surface located to receive an inertial mass impact force acting to rotate said latch about said axis toward the latched position to oppose movement of said latch from the latched position by the impact force from the gate, and a force transmitting connection between the inertial mass and the force receiving surface, wherein when the frame is impacted in a direction tending to open the gate the frame is moved relative to the inertial mass, the inertial mass generates an inertial force, and the force transmitting connection transmits the inertial force to the latch to hold the latch in the latched position to prevent opening of the gate, and wherein there is relative motion possible between the latch and the inertial mass when the frame is impacted in a direction tending to move the gate in a closing direction.

2. The outlet gate assembly of claim 1 wherein said axis extends perpendicularly to the direction of opening movement of the gate.

3. The outlet gate assembly of claim 1 wherein said latch surface is spaced a first distance from the axis of rotation of said latch and said force receiving surface is spaced a second distance from said axis of rotation of said latch, said second distance being greater than the first distance.

4. The outlet gate assembly of claim 3 wherein said second distance is about four times the first distance.

5. The outlet gate assembly of claim 3 including a member biasing said latch towards the latched position.

6. The outlet gate assembly of claim 3 wherein said force receiving surface faces away from the direction of opening movement of the gate.

7. The outlet gate assembly of claim 1 wherein said inertial latch mechanism includes a shaft rotatably mounted to said frame, and said latch is mounted on said shaft for rotation with the shaft.

8. The outlet gate assembly of claim 7 wherein said inertial mass is rotatable mounted on said shaft.

9. The outlet gate assembly of claim 8 including a first arm extending between the shaft and said inertial mass.

10. The outlet gate assembly of claim 9 wherein said inertial mass is located below said shaft.

11. The outlet gate assembly of claim 10 wherein the shaft extends transversely to the opening direction of said gate.

12. The outlet gate assembly of claim 11 wherein said inertial latch mechanism includes a second arm spaced along the shaft from the first arm, said second arm extending between the shaft and said inertial mass.

13. The outlet gate assembly of claim 12 wherein said latch is located between said first and second arms.

14. The outlet gate assembly of claim 1 wherein said inertial latch mechanism is located below said gate, said gate having upper and lower sides and including a catch member located on said lower side of the gate, and said catch member is engageable with said latch surface for holding said gate in the closed position.

15. The outlet gate assembly of claim 14 wherein said latch includes a cam surface engageable with said catch member during closing of the gate.

16. The outlet gate assembly of claim 14 wherein said path of travel is horizontal and said latch surface is offset from the vertical.

17. The outlet gate assembly of claim 1 wherein said inertial mass does not extend below said frame.

18. The outlet gate assembly as in claim 1 wherein said axis is located under said path.

19. The outlet gate assembly as in claim 18 wherein said inertial mass is located below said axis and within the frame.

20. The outlet gate assembly as in claim 1 wherein said inertial mass includes a surface abutting said contact surface.

21. An outlet gate assembly for a hopper-type railway car, said assembly comprising:

a frame defining a generally rectangular discharge opening;

a generally rectangular discharge gate mounted on said frame for opening and closing the discharge opening, said gate being movable between opened and closed positions along a predetermined path of travel, said gate including a catch;

a gate opening and closing drive directly engaging said gate to move said gate between the opened and closed positions;

an inertial latch mechanism including a latch rotatably mounted on said frame for rotation about a first axis, said latch rotatable between a latched position holding said gate in the closed position and an unlatched position, an inertial mass mounted for movement with respect to said frame, said first axis extending transversely to the direction of movement of the gate on the frame, said latch including a latch surface and a cam surface said latch surface located to engage the catch and said cam surface located in the path of movement of said catch during closing movement of die gate, said latch further including a force transmitting surface facing the inertial mass mid die inertial mass further including a contact surface facing and adjacent to die force transmitting surface, wherein when the frame is impacted in a direction tending to open the gate the frame is moved relative to the inertial mass, the contact and force transmitting surfaces abut each other, the inertial mass generates an inertial force and die inertial force is communicated to the latch through the abutting surfaces and holds the latch against the catch to prevent opening of the gate, and wherein there is relative motion possible between the latch and the inertial mass so that the contact and force transmitting surfaces may separate from each other when die frame is impacted in a direction tending to move the gate in a closing direction.

22. The outlet gate assembly of claim 21 wherein said latch surface and said force transmitting surface are spaced vertically.

23. The outlet gate assembly of claim 21 wherein said latch surface and said force transmitting surface are spaced from one another and the first axis is located between said surfaces.

24. The outlet gate assembly of claim 23 wherein said force transmitting surface is spaced a greater distance from the first axis than said latch surface.

25. The outlet gate assembly of claim 24 wherein said force transmitting surface is spaced from the first axis a distance at least four times the distance said first latch surface is spaced from the first axis.

26. The outlet gate assembly of claim 21 wherein said inertial latch mechanism includes a shaft mounted on said frame, and said latch is mounted on said shaft.

27. The outlet gate assembly of claim 26 wherein said inertial mass is mounted to said shaft.

28. The outlet gate assembly of claim 27 wherein said inertial latch mechanism includes an arm having a first end mounted on said shaft and a second end joined to said inertial mass, and said inertial mass is located below the shaft.

29. The outlet gate assembly of claim 21 wherein said inertial mass is located above the bottom of the frame.

30. The outlet gate assembly of claim 21 including a member biasing said latch towards the latched position.

31. The outlet gate assembly of claim 21 wherein said inertial latch mechanism is located between the gate and the bottom of the frame.

32. The outlet gate assembly as in claim 21 wherein said inertial mass is mounted on said frame for rotation about a second axis, and wherein both said first and second axes are located under said gate.

33. The outlet gate assembly as in claim 21 wherein said inertial latch mechanism is located under the plate.

34. The outlet gate assembly as in claim 21 wherein said inertial mass is mounted on said frame for rotation about a second axis, and wherein said first and second axes are coincident and extend in a direction transverse to the direction of movement of the gate on the frame.

* * * * *